US005637196A

United States Patent [19]

Ogawa et al.

[11] Patent Number: 5,637,196

[45] Date of Patent: Jun. 10, 1997

[54] INK JET RECORDING SHEET

[75] Inventors: Susumu Ogawa; Hideaki Senoh, both of Tokyo, Japan

[73] Assignee: Mitsubishi Paper Mills Limited, Tokyo, Japan

[21] Appl. No.: 710,935

[22] Filed: Sep. 24, 1996

Related U.S. Application Data

[63] Continuation of Ser. No. 149,544, Nov. 9, 1993, abandoned.

[30] Foreign Application Priority Data

Nov. 16, 1992 [JP] Japan ..... 4-305392
Dec. 3, 1992 [JP] Japan ..... 4-324359

[51] Int. Cl.[6] ..... D21H 19/84; B41M 1/00

[52] U.S. Cl. ..... 162/135; 162/158; 428/342; 428/341

[58] Field of Search ..... 428/340, 195, 428/323, 342, 452, 341; 162/135, 181.7, 158, 147, 198, 130, 175; 503/227; 106/214

[56] References Cited

U.S. PATENT DOCUMENTS

| | | | |
|---|---|---|---|
| 4,425,405 | 1/1984 | Murakami et al. | 428/342 |
| 4,442,172 | 4/1984 | Oshima et al. | 428/342 |
| 4,474,847 | 10/1984 | Schröder et al. | 428/323 |
| 4,503,118 | 3/1985 | Murakami et al. | 428/323 |
| 5,126,010 | 6/1992 | Kobayashi et al. | 162/135 |
| 5,190,805 | 3/1993 | Atherton et al. | 428/195 |
| 5,206,071 | 4/1993 | Atherton et al. | 428/195 |
| 5,302,437 | 4/1994 | Idei et al. | 428/195 |

FOREIGN PATENT DOCUMENTS

| | | |
|---|---|---|
| 52-53012 | 4/1952 | Japan . |
| 52-9074 | 1/1977 | Japan . |
| 55-5830 | 1/1980 | Japan . |
| 55-51583 | 4/1980 | Japan . |
| 56-157 | 1/1981 | Japan . |
| 61-235184 | 10/1986 | Japan . |
| 62-282967 | 12/1987 | Japan . |
| 2211866 | 12/1989 | United Kingdom . |

*Primary Examiner*—Donald E. Czaja
*Assistant Examiner*—Jose A. Fortuna
*Attorney, Agent, or Firm*—Armstrong, Westerman, Hattori, McLeland, & Naughton

[57] ABSTRACT

An ink jet recording sheet which includes a support comprising wood fibers and pigment and at least one ink-receiving layer provided on the support, wherein content of the pigment in the support is 5–36% by weight and the recording sheet has an internal bond strength of 150–455 g/cm. A method for producing the ink jet recording sheet is also provided. This ink jet recording sheet is less in waviness of the sheet, spread of ink dots and stain in background after ink jet recording.

6 Claims, No Drawings

INK JET RECORDING SHEET

This application is a continuation of application Ser. No. 08/149,544 filed Nov. 9, 1993, now abandoned.

BACKGROUND OF THE INVENTION

The present invention relates to an ink jet recording sheet and in particular, to an ink jet recording sheet which is extremely reduced in surface waviness of the sheet after being recorded, spread of ink dots and staining of background.

The ink jet recording method performs recording of characters and graphics by allowing ink droplets ejected by various working principles to deposit on a recording sheet such as paper. The ink jet recording has such favorable features that it makes high-speed recording possible, that is produces little noise, that it can easily perform multi-color recording, that there is no limitation as to kind of patterns or images, and that it requires no processing for development and fixing. Thus, ink jet recording is rapidly becoming widespread in various fields as devices for recording various characters including kanjis (Chinese characters) and color images. Furthermore, the images formed by the multi-color ink jet recording method are not inferior to those printed by multi-color press or those obtained by color-photography. Besides, use of the ink jet recording extends to a field of full-color image recording where number of copies is not so many, since costs per copy are less expensive than those employing the photographic process.

As for the recording sheets used for ink jet recording, efforts have been made from the aspects of printer hardware or ink composition in order to use woodfree papers or coated papers used for ordinary printing or writing. However, improvements in recording sheets have come to be required increasingly in order to go side by side with developments in printer hardware such as ever increasing speed, development of ever finer definition images of full color, and also with expanding fields of uses. That is, recording sheets are demanded to develop ever high image reproducibility, and in order to meet that demand, image density of the printed dots must be maintained high, hue characteristics must be bright and appealing, the ink applied must be fixed quickly and no bleed or spread even though a different color ink is put over additionally. Moreover, ink should set quickly, dots should not spread more than needed and the circumference of dots be sharp and demarcating.

Various proposals have been made for such demand. For example, an ink-receiving layer mainly composed of silica pigments which forms a porous layer is provided on the surface of a support to improve ink-absorbing property (Japanese Patent Application Kokai Nos. 52-9074 and 58-72495). In order to improve ink absorption property by providing an ink-receiving layer, to make printed dot density higher, and to restrain spread of ink dots, Japanese Patent Application Kokai Nos. 55-51583 and 56-157 propose to add non-colloidal silica powders to the ink-receiving layer. Based on the finding that color quality and sharpness depend on the state of the colorants distribution in the ink-receiving layer, it has been proposed to use a specific agent which adsorbs the colorant component (Japanese Patent Application Kokai No. 55-144172).

Further, as another problem encountered after recording, there is the occurrence of surface waviness of the ink jet recording sheet after printing. If the surface of the recording sheet after printing is undulating, appearance of the record appraised by senses goes down even though image reproducibility is good. The waviness is generated due to partial expansion and contraction of wood fibers in the support caused by the permeated ink. Accordingly, to inhibit permeation of the ink into the support can be a measure for avoiding the waviness. This means to provide the ink-receiving layer heavy enough to absorb most of the ink liquid, but too heavy such layer can by no means be held by binders contained in the layer and the layer will come off in a form of powders.

On the other hand, to inhibit the permeation of ink without increasing coating weight of the ink-receiving means to reduce void volume in the ink-receiving layer and the support. Reduction of void volume in the ink-receiving layer and the support causes delay in permeation of ink into the ink-receiving layer and the support, and the ink stays wet and bleeds around ink dots. Such wet ink dots stain a paper bail or other sheet transfer means of a printer, and the stain is dragged to smudge the recording sheet being printed.

In order to meet demand of recent graphics-oriented market, not only sharpness and color quality of the ink jet printed images, but also smoothness of hard copies, but also surface aesthetics is strongly demanded. The surface of sheet should be flat and smooth and free of undulation after it has received liquid ink for recording. The surface undulation or waviness, if any, also affects harmfully on runnability of the sheet on a printer since it could be a cause of jamming or smudging of the sheet. An ink jet recording sheet which inhibits ink dots spread and bleeding and is free of surface undulation after printing is demanded.

Ink jet recording sheets are classified into two categories, non-coat type and coat type. The former includes woodfree paper, bond or the like; the latter has an ink-receiving layer provided on support like paper, synthetic paper or synthetic resin film, and is further classified into light-weight coat type in which coating weight is 1–10 g/m$^2$, medium-weight coat type in which coating weight is 10–20 g/m$^2$, and heavy-weight coat type in which coating weight is 20 g/m$^2$ or more. As a support for the coat type ink jet recording sheet, paper having Stöckigt sizing degree of 0 to several ten seconds is commonly employed.

In the case of color recording, the amount of ink to be deposited is large, so that the coated layer alone cannot fully absorb the inks and it is necessary to use a paper support having relatively low sizing degree thereby to allow the support also to absorb a part of the deposited ink. However, if the paper support absorbs ink excessively, the ink tends to strike-through and the sheet tends to be cockling (wrinkling).

Furthermore, since ink-receiving layer is designed to absorb aqueous ink as quickly as possible, it is susceptible to humidity. That is, moisture causes difference in contraction and expansion between the support and the ink-receiving layer, resulting in curling of the sheet. Curling in turn harmfully affects runnability of the sheet on a printer.

In order to solve these problems, Japanese Patent Application Kokai No. 2-270588 proposes an ink jet recording paper having ink-receiving layers on the front and back sides of a paper support and Japanese Patent Application Kokai No. 62-282967 discloses a sheet having an ink-holding layer and ink-transfer layer on a support together with a curl inhibiting layer having properties same as or similar to those of the ink-holding layer. Furthermore, Japanese Patent Application Kokai No. 61-235184 discloses a recording material having an ink-receiving layer which is further provided with a curl inhibiting layer comprising a resin such as polyacrylamide and Japanese Patent Application Kokai Nos. 62-162586 and 62-162587 disclose that sheet transferability on a printer and blocking resistance are improved by providing a layer comprising a slight amount (0.01–1.0 $g/m^2$) of a powder on the side of a support opposite the ink-receiving side or on both sides.

Fastness of records or images is also an important requirement for an ink jet recording sheet. The images are required to stand wetting; the ink once set should not migrate even if water is put thereon. It is further demanded that the records or images be protected from discoloring upon exposure to light, ozone gas or oxidizing gas.

In order to meet this requirement, some proposals have been made. For example, an ink jet recording paper comprising a base paper of low sizing degree which is wetted with a coating composition for surface treatment is disclosed in Japanese Patent Application Kokai No. 52-53012, and an ink jet recording sheet loaded with urea-formaldehyde resin powder and impregnated with a water-soluble polymer is disclosed in Japanese Patent Application Kokai No. 53-49113. Moreover, an ink jet recording sheet comprising a support and an ink absorbing coating layer provided on the support is disclosed in Japanese Patent Application Kokai No. 55-5830. Use of non-colloidal silica powders as pigments in the coating layer is disclosed in Japanese Patent Application Kokai Nos. 55-51583 and 56-157. Furthermore, a coated paper having two layers differing in ink absorbing rate is disclosed in Japanese Patent Application Kokai No. 55-11829.

Many examples of using cationic dye fixers for improving water resistance are disclosed, for example, in Japanese Patent Application Kokai Nos. 60-11389, 62-238783, 64-9776 and 64-77572. Many proposals have been made for improving light resistance. In addition to these proposals, many further proposals from the side of recording sheet have been made in ink jet recording method and accordingly the quality of recorded images has also been highly improved.

On the other hand, in order to ensure high image density of printed dots, sharpness and color quality, and to utilize the characteristics of dyes, it is desired that the dye of ink be fixed on the surface of the recording sheet and the vehicle of the ink alone be absorbed underneath.

As for non-coat type ink jet recording sheet, the sheet by itself is required to absorb ink and for this purpose, a non-sized paper or a slightly sized paper containing a slight amount of a sizing agent or an increased amount of a loading material can be employed. However, when recording is carried out with an aqueous ink, such recording sheet suffers from the problems that though the sheet is superior in absorbency for ink, color quality, sharpness and density of printed dots and images are low, and deterioration in the shape of dot called "feathering" (jagged in the form of bird feather) and blurring of the contour of the dot occur and the ink permeates into the base paper layer deeply and reaches the back side of the paper.

On the other hand, as for the coat type ink jet recording sheet, a recording sheet comprising a non-sized or a slightly sized paper as a support provided with a coating layer is superior in absorbing property and is improved in color quality, sharpness and inhibited from feathering of the resulting images and is inhibited from strike-through of ink as compared with the non-coated type ink jet recording sheet. Particularly, images recorded on a recording sheet provided with a coating layer containing an amorphous silica powder and a water-soluble polymer material have excellent color quality, sharpness and resolution and are inhibited from feathering and strike-through of ink.

Furthermore, as for the recording sheets having a coating layer on a support such as high-sized paper, polyethylene terephthalate film or synthetic paper which does not absorb or hardly absorbs vehicle of aqueous ink, since the support per se hardly absorbs the solvent of ink, the dye is retained on the surface of the recording sheet and image reproducibility with excellent dot density, image density, color quality, sharpness and little feathering and strike-through can be readily obtained. However, when the coating weight is small, absorbency for ink is low and particularly, ink absorbing rate in color-overlapping recording is low and absorption capacity also decreases. If the coating weight is increased for increasing the absorption capacity, the bond between the coating layer and support tends to be weak and the coated layer components tend to come off in a form of powder. Thus, improvement is needed.

These coat type ink jet recording sheets can afford high image density, excellent color quality and sharpness with less feathering and strike-through and excellent image reproducibility. It is considered that this is because voids present inside the particles such as amorphous silica powders are large and the amount of the ink absorbed in the powders, namely, in the coating layer, is large; the powders are fine powders at least 90% of which have a volume average particle size of 1–20 μm; refractive index of the powders is small; and light scattering coefficient is small. However, quality demand for the ink jet recording sheet, in terms of color quality, sharpness, feathering, runnability, etc., is growing ever stringent, and improvement of the coated layer alone can no longer meet such demand.

SUMMARY OF THE INVENTION

The object of the present invention is to provide a coat type ink jet recording sheet less in surface waviness of the sheet after printing and markedly reduced in spread of ink dots and background staining which relate to the sharpness and color quality of prints.

As a result of intensive research on ink jet recording sheets conducted by the inventors, it has been found that the above object can be attained by using a support mainly composed of wood fibers and pigment which contain the pigment in an amount of a specific range and which has an internal bond strength in a specific range.

That is, the present invention provides an ink jet recording sheet comprising a support mainly composed of wood fibers and pigment and at least one ink-receiving layer provided on the support wherein the support contains 5–36% by weight of the pigment and the recording sheet has an internal bond strength of 150–455 g/cm.

DETAILED DESCRIPTION OF THE INVENTION

The internal bond strength of the ink jet recording sheet of the present invention is a parameter which shows the strength of the support mainly composed of wood fibers and pigment in Z-direction. The inventors have found that the internal bond strength and the content of the pigment in combination relate to the occurrence of waviness and spread of ink dots after printing.

The internal bond strength as used herein is measured in accordance with Tappi Useful Methods 403 and normally refers to internal bonding energy of a fibrous integrity free from any influence of coating. When the ink-receiving layer is applied on the support, liquor in the coating composition permeates into it and modifies the internal structure of the support and accordingly the internal bond strength. The inventors of the present invention have found that by regulating both the internal bonding strength of the coated sheet and ash content of the support, an ink jet recording sheet which is extremely reduced in surface waviness after recording, spread of ink dots, and staining of background is obtained. In order to increase the internal bond strength, it is generally exercised to increase the amount of a binder or a so-called paper strengthening agent such as polyacrylamide. This results in an increase of the internal bond strength, but also in an increase in sizing degree. The increase in sizing degree causes a decrease in spread of ink dots, but may result in staining in the background of the ink jet recording sheet due to the delay in permeation of ink.

The internal bond strength of the support in the present invention is determined by its structure formed of an inter-fibers network with pigment lying among them. The sizing degree that affects permeation of ink involves a chemical aspect and a physical aspect; the former being that that electrical charge state determines permeation of ink and the latter being that the state of void capillary of the support determines permeation of ink. Increase in pigment content in the support results in a decrease in the internal bond due to decrease in inter-fiber bond by hydrogen bonding, but in an increase in void capillaries of the support due to the pigment standing among the fibers.

Therefore, for attaining the object of the present invention, the internal bond should be high enough to control spread of ink dots or to inhibit surface waviness of the sheet after recording, but should not too high to harmfully affect the permeation rate of the ink. As a result, it has been found that an ink jet recording sheet free from surface waviness after recording and little in spread of ink dots can be obtained only when the internal bond strength is in the specific range of 150–455 g/cm and the pigment content is in the specific range of 5–36% by weight, preferably 5–30% by weight.

There are a variety of conditions that affect internal bond strength of the ink jet recording sheet. In forming paper for the support, mention may be made of, for example, fiber furnish and freeness of the fiber stock, ash content, kinds and amount use of agent for internal sizing and surface sizing, calendering, etc.; in coating the ink-receiving layer, kind and amount of use of binder and coating pigment, solid content of the coating composition, coating method, drying rate, calendering, etc. Process conditions may differ from place to place, but those conditions can be optimally adjusted to bring the pigment content and the internal bond strength within the aforesaid range.

The coating weight of the ink-receiving layer is not specifically limited, but if it is too small, image density is low and color quality and sharpness of the image are inferior and feathering occurs though ink absorption property is good. If the coating weight is too large, drying load in the drying step after coating increases, resulting not only in decreased productivity but also in binder migration, i.e., the binder in the ink-receiving layer composition migrates to the surface of the ink-receiving layer together with vapor and reduces the voids on the surface of the ink-receiving layer to cause staining of the background when the sheet is printed. While the intensity of the binder migration is affected by concentration of the coating composition or capacity of the drying step, the coating weight is preferably 1–10 g/m$^2$. Furthermore, a backcoat layer may be provided in the present invention. The coating weight of the backcoat layer is not specifically limited and is desirably selected depending on the coating or impregnating devices or the capacity of the drying step.

The support used in the present invention is mainly composed of wood fibers and pigment. The wood fibers include, for example, a chemical pulp such as LBKP or NBKP, a mechanical pulp such as GP, PGW, RMP, TMP, CTMP, CMP or CGP or a waste paper pulp such as DIP. The support can be produced by mixing the wood fibers with a known pigment and optionally at least one of the additives such as binder, sizing agent, fixing agent, retention aid, cationizing agent and paper strengthening agent and making papers from the resulting mixture by various formers such as Fourdrinier paper machine, cylinder paper machine, twin wire paper machine, or the like, under an acidic, neutral or alkaline system. The ink-receiving layer may be provided on the resulting support as it is or after a size press coat layer or an anchor coat layer of starch, polyvinylalcohol or the like has been provided on the support. Furthermore, smoothness of the support may be controlled by a machine calender, a TG calender, a soft calender or the like.

The support, the ink-receiving layer and the backcoat layer used in the present invention may contain at least one known white pigment. Examples of the white pigment are inorganic white pigments such as precipitated calcium carbonate, ground calcium carbonate, kaolin, talc, calcium sulfate, barium sulfate, titanium dioxide, zinc oxide, zinc sulfide, zinc carbonate, satin white, aluminum silicate, diatomaceous earth, calcium silicate, magnesium silicate, synthetic amorphous silica, colloidal silica, colloidal alumina, pseudo boehmite, aluminum hydroxide, alumina, lithopone, zeolite, hydrated halloysite, magnesium carbonate and magnesium hydroxide and organic pigments such as polystyrene plastics pigment, polyacrylic plastics pigment, polyethylene, microcapsules, urea resin and melamine resin. Among them, porous inorganic pigments are preferred as white pigments to be contained in the ink-receiving layer as a main component and include, for example, porous synthetic amorphous silica, porous magnesium carbonate and porous alumina, and the porous synthetic amorphous silica having a large pore volume is especially preferred.

As the binders, there may be used, for example, polyvinyl alcohol, vinyl acetate, oxidized starch, etherified starch, cellulose derivatives such as carboxymethylcellulose and hydroxyethylcellulose, casein, gelatin, soybean protein, sillyl-modified polyvinyl alcohol; conjugated diene copolymer latexes such as maleic anhydride resin, styrene-butadiene copolymer and methyl methacrylate-butadiene copolymer; acrylic polymer latexes such as polymers or copolymers of acrylate esters and methacrylate esters and polymers or copolymers of acrylic acid and methacrylic acid; vinyl polymer latexes such as ethylene-vinyl acetate copolymer; functional group-modified polymer latexes obtained by modifying the above-mentioned various polymers with monomers containing functional group such as carboxyl group; aqueous adhesives such as thermosetting synthetic resins, for example, melamine resin and urea resin; synthetic resin adhesives such as polymethyl methacrylate, polyurethane resin, unsaturated polyester resin, vinyl chloride-vinyl acetate copolymer, polyvinyl butyryl and alkyd resin. These may be used each alone or in combination of two or more.

Furthermore, as other additives, there may be added pigment dispersant, thickening agent, fluidity improver, defoamer, foam inhibitor, releasing agent, foaming agent, penetrant, coloring dye, coloring pigment, fluorescent brightener, ultraviolet absorber, anti-oxidant, preservative, slimecide, water proofing agent, wet strengthening agent and dry strengthening agent.

For coating or impregnating the support with the ink-receiving layer or backcoat layer, there may be used various coaters such as a blade coater, roll coater, air knife coater, bar coater, rod blade coater, short dwell coater and size press in the manner of on-machine or off-machine. Particularly, when the support having water absorbency is coated with the ink-receiving layer or the backcoat layer, it is necessary to control the permeation rate of solvent or the like contained in the coating composition into the support. The permeation of the solvent readily takes place when the solid concentration of the coating composition is low or when the water retention of the coating composition is low. This permeation of the solvent not only causes an increase of solid concentration of the coating composition and makes it difficult to control the coating weight in coating, but also sometimes causes a decrease in the strength of the ink-receiving layer or the backcoat layer since the binder in the coating composition also permeates into the support together with the solvent. In addition, when the solid concentration of the coating composition is low, not only the permeation of the solvent, but also the load in the drying step increases to bring about the binder migration to the surface of the layers, resulting in reduction of voids. Furthermore, if the migration of the binder nonuniformly proceeds, the surface of the ink-receiving layer also has a nonuniform structure and the shape and size of ink dots also become nonuniform, resulting in deterioration of image reproducibility.

Permeation of solvent, water or the like of the coating composition into the support takes place instantly as soon as they are brought into contact, therefore it is preferable to select an applicating and metering system that can restrict such permeation. In this regard, the system that applicates a pre-metered amount of the coating composition or allows the highest possible solid coating is preferred, and the effects of the present invention are further enhanced by use a roll coater, where amount of the coating composition is metered prior to being coated, or a rod coater that allows a high solid coating. The coated web is then dried and may be surface-finished using calenders such as machine calender, TG calender, super calender and soft calender.

The aqueous ink referred to in the present invention is a recording solution comprising the following colorant, vehicle and other additives.

The colorants include water-soluble dyes such as direct dyes, acid dyes, basic dyes, reactive dyes and food dyes.

The vehicles for the aqueous ink include water and various water-soluble organic solvents, for example, alkyl alcohols of 1 to 4 carbon atoms such as methyl alcohol, ethyl alcohol, n-propyl alcohol, isopropyl alcohol, n-butyl alcohol, sec-butyl alcohol, tert-butyl alcohol and isobutyl alcohol; amides such as dimethyl formamide and dimethylacetamide; ketones or ketone alcohols such as acetone and diacetone alcohol; ethers such as tetrahydrofuran and dioxane; polyalkylene glycols such as polyethylene glycol and polypropylene glycol; alkylene glycols having 2 to 6 alkylene groups such as ethylene glycol, propylene glycol, butylene glycol, triethylene glycol, 1,2,6-hexanetriol, thiodiglycol, hexylene glycol and diethylene glycol; and lower alkyl ethers of polyhydric alcohols such as glycerin, ethyleneglycol methyl ether, diethylene glycol methyl (or ethyl) ether and triethylene glycol monomethyl ether. Of these many water-soluble organic solvents, preferred are polyhydric alcohols such as diethylene glycol and lower alkyl ethers of polyhydric alcohols such as triethylene glycol monomethyl ether and triethylene glycol monoethyl ether. As the other additives, mention may be made of, for example, pH buffers, sequestering agents, slimecides, viscosity modifiers, surface tension modifiers, wetting agents, surface active agents and rust inhibitors.

The ink jet recording sheet of the present invention can be used not only as an ink jet recording sheet, but also as any sheet recordable by use of inks which are liquid at the time of recording. These recording sheets include, for example, a receiving sheet for heat transfer recording, where a donor sheet comprising a thin support such as a resin film and a heat-meltable ink layer provided thereon mainly composed of a heat-meltable wax and colorants is heated from the back side to fuse the ink layer and let it transfer; a specific ink jet recording sheet where a solid but heat-fusible ink is molten and jetted onto it to perform recording, an another specific ink jet recording sheet where an ink solution is oleophilic one containing an oil-soluble dye therein; and a receiving sheet to be used with a photo/pressure-sensitive donor sheet coated with microcapsules containing a photopolymerizable monomer and colorless or colored dye or pigment.

These recording sheets are common in that the ink used is in a liquid state at the time of recording. A liquid ink permeates or diffuses vertically and horizontally into the ink-receiving layer until ink is hardened, solidified or fixed. The above-mentioned various recording sheets require the ink absorbency in conformity with the respective recording methods and the ink jet recording sheet of the present invention can be utilized as the above-mentioned various recording sheets.

The ink jet recording sheet of the present invention can be used as the recording sheets for electrophotographic recording on which a toner is fixed by heating and which are widely used in copying machines, printers and the like.

In the ink jet recording sheet of the present invention, when the pigment content in the support is less than 5% by weight and the internal bond strength of the recording sheet is less than 150 g/cm, the surface waviness of the sheet occurs after recording and besides the spread of ink dots increases. Furthermore, when the internal bond strength of the recording sheet exceeds 500 g/cm, though surface waviness does not occur, permeation of the ink in Z-direction of the sheet is hindered and hence, the ink diffuses in a horizontal direction to increase spread of ink dots. Furthermore, the influence of the content of pigment diminishes and permeation and diffusion of ink are delayed to cause staining of background in the ink jet printer to damage the appearance of the prints. Thus, from practical point of view, the upper limit of the internal bond strength should be set at 455 g/cm.

When the content of pigment in the support is 5–36% by weight and the internal bond strength of the recording sheet is 150–455 g/cm, an ink jet recording sheet which is free from the surface waviness after recording and has little in spread of ink dots can be obtained.

As a result of further investigations on an ink jet recording sheet, the inventors have further found that the above-mentioned characteristics of the recording sheet differ depending on the distribution of the pigment in a section of the support mainly composed of wood fibers and pigment.

That is, when an electron microscopic photograph of a cross section of the support is taken, the section is divided into two halves at center, and pigment area in each half, S1 and S2— for lower ash half and higher ash half respectively, is determined by an image analysis, and area ratio S1/S2 is calculated; the area ratio preferably falls within a range 25/75–45/55 and the ink-receiving layer is preferably applied on the S2 (higher ash) side of the support.

The support of the ink jet recording sheet according to the present invention contains the pigment in an amount of preferably at least 10% by weight and more preferably at least 20% by weight, wherein the effect on ink jet recording properties can be more surely obtained.

Furthermore, the method for producing the ink jet recording sheet comprising a support mainly composed of wood fibers and pigment and an ink-receiving layer provided on the support according to the present invention is characterized in that when a cross section of the support is divided into two halves, the area ratio S1/S2 of the pigment contained in the respective halves is 25/75–45/55, and at least one ink-receiving layer is coated on the S2 (higher ash) side of the support by a roll coater or a rod coater.

As explained above, ink jet recording sheets are required to have the characteristics such as a high ink absorbing rate, a large ink absorption capacity, little strike-through, little cockling, a high image density and an excellent image reproducibility. For a coat type ink jet recording sheet, the ink absorption characteristic is of importance because the vehicle of the ink permeates to the support from the ink-receiving layer. Accordingly, by providing the ink-receiving layer on the S2 (higher ash) side, the vehicle of the ink which permeates through the ink-receiving layer is readily adsorbed onto the surface of the pigment in the support or is absorbed into the voids formed by the wood fibers and the pigment, and, as a result, an ink jet recording sheet which has a large ink absorbing capacity, can give a high image density, has image reproducibility with superior color quality and sharpness and is inhibited from strike-through or cockling.

On the other hand, when the ink-receiving layer is provided on the S1 (lower ash) side of the support, the ink absorbing capacity decreases and besides, since the ink diffuses along the wood fibers, feathering occurs and the image reproducibility deteriorates.

The support is a fiber network formed of wood fibers and pigment and has voids in it. The voids affect not only absorption performance of the ink jet recording sheet, but also affect formation of the voids in the ink receiving layer since they influence the way aqueous components of the coating composition permeate into the support. Changes of the voids after coating the ink receiving layer composition can be recognized by observing a cross section of the sheet using an electron microscope. Presence of relatively smaller voids can be confirmed near the boundary between the support and coated layer.

It has been found that those relatively smaller voids have an influence on the ink jet recording performance and their formation in turn is affected not only by amount of the pigment loaded into the support but also by distribution of the pigment along Z-direction of the support. The pigment distribution can be characterized by the aforesaid pigment area ratio, S1/S2, can be controlled by adjusting paper forming conditions or additives in the paper stock, and it has been found that the pigment area ratio affects the ink jet recording performance of the recording sheet.

When the pigment area ratio S1/S2 decreases, the non-uniformity of the support layer mainly composed of wood fibers and pigment becomes conspicuous and there occurs the problem of so-called two-sidedness. This problem, if very intense, leads to difficulties in controlling curl and affects harmfully runnability of the recording sheet on a printer. Moreover, when an ink-receiving layer is provided on that intensively higher ash side of the support, the binder component in the ink-receiving layer composition selectively permeates into the support at the time of coating, resulting in a shortage of the binder in the ink-receiving layer and accordingly in poor surface strength of the ink-receiving layer and the layer components come off easily in a form of powder. If greater amount of the binder is used to prevent such powdering, voids in the ink-receiving layer decrease and permeation of ink is hindered to cause diffusion of the ink in the horizontal direction resulting in change of dots shape or spread. In addition, since the ink dots tend to stay wet, which, if dragged by a paper bail or other sheet transfer means, smudge the sheet. As a result, the image repoducibility and quality are considerably impaired and such sheet can by no means be of use.

The ink-receiving layer should have continuous voids, namely, fine pores which plays a role of capillaries and the vehicle of the ink permeates together with a dye both horizontally and vertically. If the permeation direction is too much in favor the horizontal direction, sharpness deteriorates or ink dots, particularly in the color overlapping portions, smear beyond the boundary of dots resulting in poor color quality and color reproducibility since a color in those portions reflects mixing of the dyes. Moreover, image density becomes poor. Accordingly, in order to obtain an ink jet recording sheet which can provide an image excellent in color quality and sharpness and which has good image reproducibility, it is essential to control both the horizontal and vertical permeation direction of ink, to thereby obtain optimum dot diameter and a dot shape near a complete circle.

By providing an ink-receiving layer on the higher ash side of the support, a coat type ink jet recording sheet which can provide images of high density and is less in strike-through and cockling and which is also reduced in spread of ink dots in color-overlapping portion can be obtained. Since the ink permeates not only into the ink-receiving layer, but also into the support, ink absorbency characteristics also can be imparted to the support. The higher ash side of the support on which an ink-receiving layer is provided allows greater adsorption of ink to the pigment and has a porous void structure to facilitate ink absorption, and thus, the resulting image has a high density and is excellent in color quality and sharpness. Furthermore, owing to the large ink absorbing capacity, strike-through and cockling is inhibited and besides, since diffusion of the ink along the wood fibers can be prevented, occurrence of feathering can also be inhibited.

DESCRIPTION OF THE PREFERRED EMBODIMENT

The following examples are illustrative of the present invention and are not intended for purposes of limitation. All parts and % are by weight unless otherwise specified. The measurement and evaluation were conducted under the environment as specified in JIS P8111 unless otherwise specified.

(1) Content of the pigment in the support:

Absolute dry weight $W_0$ of the support was measured and this support was put in a crucible and burnt at 550° C. Weight W of the residue in the crucible was measured and ash content P (%) was calculated from the following formula (1).

$$P\ (\%)=(W/W_0)\times 100 \quad (1)$$

(2) Internal bond strength of ink jet recording sheet:

This was measured in accordance with the method specified in Tappi Useful Methods 403 using Internal Bond Tester (Kumagaya Riki Kogyo Co.). The results obtained are expressed by the unit g/cm which is the same as g·cm/cm$^2$.

(3) Degree of overlapping ink dots spread:

Monochromatic magenta ink dots and overlapping dots using two monochromatic inks, magenta and cyan, are put on a specimen sheet. The ratio of the dot diameter of the overlapping ink dot (CM–magenta+cyan) to same of the monochromatic magenta ink dot (M), i.e. CM/M, was evaluated. The closer the ratio CM/M was to 1.0, the smaller the difference between CM and M, meaning that the color quality and sharpness of the resulting image are superior.

(4) Surface waviness:

The surface of a specimen sheet after printing was visually inspected and the surface waviness was graded by the following criteria. The results shown by A and B are acceptable.

A: The surface waviness was not found and appearance appraisable by senses was not affected.

B: Certain surface waviness was found but appearance appraisable by senses was not affected.

C: The surface waviness was appreciable and appearance appraisable by senses was affected.

(5) Stain in background:

An area of blue solid image (by overlapping cyan and magenta) was printed on a specimen sheet and right after printing, a white paper was pressed onto the printed surface. The state of ink transferred to the white paper was visually examined and graded by the following criteria. The results shown by A and B are not considered to be a problem in practical use.

A: No ink was transferred and no possibility of staining.

B: Ink was slightly transferred but this was safe in practical use.

C: Ink was transferred to the whole area of the solid image and was determined a problem in practical use.

(6) Area ratio of pigment in the support:

A specimen sheet was soaked in a polyester prepolymer solution (Technovit manufactured by Kulzer) and was cured to make the sheet-embedded block, which was cut into a thin section using a microtome. The resulting section was metallized with gold by vapor deposition and was photographed using an electron microscope at a magnification of ×500. Furthermore, the photographed picture was enlarged at a magnification of ×4, and then was processed by an image analyzer to develop a binary digital picture, by which wood fibers and the pigment were separated to enable calculation of the pigment section area.

The picture was divided into 2 halves by a center line drawn at center to both edges of the section, and the pigment section area in the view field, except ones locating on the center line, was calculated and summed up to make S1 and S2, where S1 denotes the pigment section area for the smaller area half and S2 same for the other half. The ratio S1/S2 is taken to be the area ratio of pigment.

Ink jet recording properties were measured by the following methods under the conditions specified in JIS P8111 (temperature: 20° C., humidity: 65% RH).

(7) Image density:

The printed image density was evaluated by measuring the optical density of monochromatic solid images formed by printing with each of black, yellow, magenta and cyan inks using an ink jet printer IO-720 manufactured by Sharp Corporation. The higher value indicates the higher and the better density. For example, in the case of black, a value of 1.30 or higher shows that the density is sufficient.

(8) Diameter of printed dot:

Three kinds of ink dots, monochromatic cyan, monochromatic magenta, and overlapping cyan and magenta, were printed on a specimen sheet using an ink jet printer IO-720 manufactured by Sharp Corporation. Then, diameter of the dot as circle (HD) was calculated by the following formula (4) based on the dot area (A) determined by an image analyzer.

$$HD=\{(4/\pi)\times A\}^{1/2} \quad (2)$$

In the above formula, HD denotes the diameter of the dot as a circle (Heywood Diameter: μm) and A denotes an actually measured area ($\mu m^2$).

(9) Cockling:

An area of blue solid image (by overlapping cyan and magenta) was printed on a specimen sheet using an ink jet printer IO-720 manufactured by Sharp Corporation and state of cockling was visually inspected. In the following criteria, the ink jet recording sheets of A and B are acceptable. Criteria for judging the cockling:

A: Substantially no cockling of sheet observable (good).

B: Slight cockling observable (practically acceptable).

C: Considerable cockling observable (practically unacceptable).

(10) Strike-through:

An area of blue solid image (by overlapping cyan and magenta) was printed on a specimen sheet using an ink jet printer IO-720 manufactured by Sharp Corporation, and the optical density of the magenta color on the back was measured. When the optical density is 0.25 or less, there is substantially no problem in practical use, but the value exceeding 0.25 indicates that considerable strike-through has taken place and that the sheet is not suitable for practical use.

EXAMPLE 1

A support was produced by mixing 100 parts of a wood pulp comprising 80 parts of LBKP (freeness: 400 ml csf) and 20 parts of NBKP (freeness: 450 ml csf) with 7 parts of pigments comprising precipitated calcium carbonate/ground calcium carbonate/talc (10/10/10), 0.10 part of commercially available alkyl ketene dimer and 0.05 part of commercially available cationic acrylamide having a molecular weight of 5,000,000 and making the mixture into a paper of 90 $g/m^2$ in basis weight and 5.2% in pigment content by a Fourdrinier paper machine. The resulting support was surface-finished by a calender. An ink-receiving layer and a backcoat layer were provided on the thus obtained support and then subjected to calendering treatment to obtain an ink jet recording sheet having an internal bond strength of 216 g/cm.

That is, a coating composition comprising 100 parts of synthetic amorphous silica (Finesil X37B manufactured by Tokuyama Soda Co., Ltd.), 50 parts of polyvinyl alcohol (PVA 117 manufactured by Kuraray Co., Ltd.) and 20 parts of a cationic dye fixer (Sumirase Resin 1001 manufactured by Sumitomo Chemical Co., Ltd.) was prepared. The resulting coating composition of 13% in solid concentration was coated on the surface of the support at a coating weight of 5 $g/m^2$ by an air knife coater. Furthermore, a backcoat layer was provided on another side of the support. That is, a coating composition comprising 100 parts of kaolin (Hydrasperse manufactured by Huber Corporation), 5 parts of polyvinyl alcohol (R Polymer 1130 manufactured by Kuraray Co., Ltd.) and 15 parts of a styrene•butadiene latex (0617 manufactured by Japan Synthetic Rubber Co., Ltd.) was prepared. The resulting coating composition of 35% in solid concentration was coated on the another side of the support at a coating weight of 5 $g/m^2$ by an air knife coater.

EXAMPLE 2

A support produced in the same manner as in Example 1 was surface-sized with 3 $g/m^2$ of a starch (MS3800 manufactured by Japan Shokuhin Kako Co.) by an inclined size press and then was surface-finished by a calender. Thereafter, the same ink-receiving layer and backcoat layer as in Example 1 were coated, followed by calendering treatment to obtain an ink jet recording sheet having an internal bond strength of 455 g/cm.

EXAMPLE 3

A support was produced by mixing 100 parts of a wood pulp comprising 80 parts of LBKP (freeness: 400 ml csf) and 20 parts of NBKP (freeness: 450 ml csf) with 15 parts of pigments comprising precipitated calcium carbonate/ground carbonate/talc (10/10/10), 0.10 part of commercially available alkyl ketene dimer, 0.05 part of commercially available cationic acrylamide having a molecular weight of 5,000,000, 1.0 part of commercially available cationized starch and 0.5 part of aluminum sulfate and making the mixture into a paper of 90 g/m$^2$ in basis weight and 10.2% in pigment content by a Fourdrinier paper machine. The thus obtained support was surface-finished by a calender. The same ink-receiving layer and backcoat layer as in Example 1 were provided on the support and then subjected to calendering treatment in the same manner as in Example 1 to obtain an ink jet recording sheet having an internal bond strength of 280 g/cm.

EXAMPLE 4

A support was produced by mixing 100 parts of a wood pulp comprising 80 parts of LBKP (freeness: 350 ml csf) and 20 parts of NBKP (freeness: 400 ml csf) with 60 parts of pigments comprising precipitated calcium carbonate/ground carbonate/talc (10/10/10), 0.05 part of commercially available alkyl ketene dimer, 0.05 part of commercially available cationic acrylamide having a molecular weight of 7,000,000, 1.0 part of commercially available cationized starch and 0.5 part of aluminum sulfate and making the mixture into a paper of 90 g/m$^2$ in basis weight and 35.5% in pigment content by a Fourdrinier paper machine. The thus obtained support was surface-finished by a calender. The same ink-receiving layer and backcoat layer as in Example 1 were provided on the support and then subjected to calendering treatment in the same manner as in Example 1 to obtain an ink jet recording sheet having an internal bond strength of 152 g/cm.

EXAMPLE 5

A support produced in the same manner as in Example 4 was surface-sized with 4 g/m$^2$ of a starch (MS3800 manufactured by Japan Shokuhin Kako Co.) by an inclined size press and then was surface-finished by a calender. Thereafter, the same ink-receiving layer and backcoat layer as in Example 1 were coated, followed by calendering treatment in the same manner as in Example 1 to obtain an ink jet recording sheet having an internal bond strength of 424 g/cm.

Comparative Example 1

A support was produced by mixing 100 parts of a wood pulp comprising 80 parts of LBKP (freehess: 400 ml csf) and 20 parts of NBKP (freehess: 450 ml csf) with 5 parts of pigments comprising precipitated calcium carbonate/ground carbonate/talc (30/35/35), 0.10 part of commercially available alkyl ketene dimer and 0.05 part of commercially available cationic acrylamide having a molecular weight of 2,000,000 and making the mixture into a paper of 90 g/m$^2$ in basis weight and 3.9% in pigment content by a Fourdrinier paper machine. The thus obtained support was surface-finished by a calender. The same ink-receiving layer and backcoat layer as in Example 1 were provided on the support and then subjected to calendering treatment in the same manner as in Example 1 to obtain an ink jet recording sheet having an internal bond strength of 136 g/cm.

Comparative Example 2

A support produced in the same manner as in Example 1 was surface-sized with 5 g/m$^2$ of a starch (MS3800 manufactured by Japan Shokuhin Kako Co.) by an inclined size press and then was surface-finished by a calender. Thereafter, the same ink-receiving layer and backcoat layer as in Example i were coated, followed by calendering treatment in the same manner as in Example 1 to obtain an ink jet recording sheet having an internal bond strength of 560 g/cm.

Comparative Example 3

A support produced in the same manner as in Example 4 was surface-sized with 6 g/m$^2$ of a starch (MS3800 manufactured by Japan Shokuhin Kako Co.) by an inclined size press and then was surface-finished by a calender. Thereafter, the same ink-receiving layer and backcoat layer as in Example 1 were coated, followed by calendering treatment in the same manner as in Example 1 to obtain an ink jet recording sheet having an internal bond strength of 512 g/cm.

EXAMPLES 6–9

The procedure of Example 3 was repeated except that the coating weight of the ink-receiving layer was 1 g/m$^2$, 2.5 g/m$^2$, 7.5 g/m$^2$ and 10 g/m$^2$ to obtain ink jet recording sheets.

Construction of the samples obtained above and results of evaluation thereof are shown in Table 1.

TABLE 1

| Example No. | Example 1 | Example 2 | Example 3 | Example 4 | Example 5 | Comparative Example 1 | Comparative Example 2 | Comparative Example 3 | Example 6 | Example 7 | Example 8 | Example 9 |
|---|---|---|---|---|---|---|---|---|---|---|---|---|
| [Support] Paper machine | Fourdrinier paper machine | | | | | | | | | | | |
| LBKP (Part) | 80 | | | | | | | | | | | |
| Freeness mlcsf | 400 | | | 350 | | 400 | | 350 | 400 | | | |
| NBKP (Part) | 20 | | | | | | | | | | | |
| Freeness mlcsf | 450 | | | 400 | | 450 | | 400 | 450 | | | |

TABLE 1-continued

| Example No. | Example 1 | Example 2 | Example 3 | Example 4 | Example 5 | Comparative Example 1 | Comparative Example 2 | Comparative Example 3 | Example 6 | Example 7 | Example 8 | Example 9 |
|---|---|---|---|---|---|---|---|---|---|---|---|---|
| Pigment (Part) | 7 | | 15 | 60 | | 5 | 7 | 60 | 15 | | | |
| Precipitated calcium carbonate | 2.3 | | 5 | 20 | | 1.5 | 2.3 | 20 | 5 | | | |
| Heavy calcium carbonate | 2.3 | | 5 | 20 | | 1.75 | 2.3 | 20 | 5 | | | |
| Talc | 2.3 | | 5 | 20 | | 1.75 | 2.3 | 20 | 5 | | | |
| Alkyl ketene dimer | 0.10 | | 0.10 | 0.05 | | 0.10 | 0.10 | 0.05 | 0.10 | | | |
| Cationic acrylamide | 0.05 | | 0.05 | 0.05 | | 0.05 | 0.05 | 0.05 | 0.05 | | | |
| Cationized starch | — | | 1.0 | 1.0 | | — | — | 1.0 | 1.0 | | | |
| Aluminum sulfate | — | | 0.5 | 0.5 | | — | — | 0.5 | 0.5 | | | |
| Basis weight (g/m$^2$) | 90 | | | | | | | | | | | |
| Content of pigment (wt %) | 5.2 | | 10.2 | 35.5 | | 3.9 | 5.2 | 35.5 | 10.2 | | | |
| Amount of starch (size pressed) MS3800 g/m$^2$ | — | 3.0 | — | — | 4.0 | — | 5.0 | 6.0 | — | | | |
| Pigment area ratio in section S1/S2 | 28/72 | | 33/67 | 35/65 | | 29/71 | 28/72 | 35/65 | 33/67 | | | |
| Coated side of ink receiving layer | S2 side | | | | | | | | | | | |
| [Ink-receiving layer] | | | | | | | | | | | | |
| Synthetic amorphous silica | 100 | | | | | | | | | | | |
| Polyvinyl alcohol | 50 | | | | | | | | | | | |
| Cationic dye fixer | 20 | | | | | | | | | | | |
| Solid concentration (%) | 13 | | | | | | | | | | | |
| Coating amount (g/m$^2$) | 5 | | | | | | | | 1 | 2.5 | 7.5 | 10 |
| Coating method | Air knife | | | | | | | | | | | |
| [Backcoat layer] | | | | | | | | | | | | |
| Kaolin | 100 | | | | | | | | | | | |
| Polyvinyl alcohol | 5 | | | | | | | | | | | |
| SBR latex 0617 | 15 | | | | | | | | | | | |
| Solid concentration (%) | 35 | | | | | | | | | | | |
| Coating amount (g/m$^2$) | 5 | | | | | | | | | | | |
| Coating method | Air knife | | | | | | | | | | | |
| Internal bond strength g/cm | 216 | 455 | 280 | 152 | 424 | 136 | 560 | 512 | 202 | 245 | 370 | 453 |
| Degree of spread of ink dots in ink overlapped portion | 1.19 | 1.17 | 1.13 | 1.08 | 1.09 | 1.36 | 1.30 | 1.27 | 1.15 | 1.14 | 1.11 | 1.10 |
| Waviness after printing | A | A | A | B | A | C | A | A | B | A | A | A |
| Staining | A | A | A | A | A | A | C | C | A | A | A | A |

Note) "Internal bond strength" is usually measured for non-coated paper, but here the strength of recording sheet provided with ink-receiving layer and backcoat layer and subjected to calendering was measured.

As can be seen from Table 1, the ink jet recording sheets having a pigment content in the specific range of 5–36% by weight in their support and having an internal bond strength in the specific range of 150–455 g/cm which were obtained in Examples 1–5 according to the present invention are less in surface waviness and stain of background after printing, lower in the degree of spread of ink dots in the ink overlapped portions and excellent in sharpness and color quality of the resulting images. On the other hand, the ink jet recording sheets which are outside the ranges in the above-mentioned pigment content and the internal bond strength which were obtained in Comparative Examples 1–3 are high in the degree of spread of ink dots in the ink overlapped portions. Furthermore, the ink jet recording sheet obtained in Comparative Example 1 which is low in internal bond strength shows considerable waviness after printing and those obtained in Comparative Examples 2 and 3 which are high in internal bond strength show considerable stain irrespective of the pigment content. The increase of the degree of spread of ink dots in Comparative Examples 2 and 3 is considered to occur due to the diffusion of ink in the horizontal direction owing to hindrance of permeation of ink in the direction of thickness of the support.

Thus, when the content of the pigment in the support and the internal bond strength of the recording sheet are set in specific ranges, surface waviness, spread of ink dots and stain of background in the ink jet recording sheet can be markedly reduced.

EXAMPLE 10

A support was produced by mixing a wood pulp 5 comprising 80 parts of LBKP (freeness: 400 ml csf) and 20 parts of NBKP (freeness: 480 ml csf) with 30 parts of pigments comprising precipitated calcium carbonate/ground carbonate/talc (30/35/35), 0.08 part of commercially available alkyl ketene dimer and 0.03 part of commercially available cationic acrylamide having a molecular weight of 7,000,000 and making the mixture into a paper by a Fourdrinier paper machine to obtain a support for ink jet recording sheet. The resulting support had a basis weight of 90 g/m$^2$, an ash content of 17.5% and a pigment area ratio of 35/65.

An ink-receiving layer was provided by coating a coating composition comprising 100 parts of synthetic amorphous silica (Finesil X37B manufactured by Tokuyama Soda Co., Ltd.) and 60 parts of polyvinyl alcohol (PVA 117 manufactured by Kuraray Co., Ltd.) and having a solid concentration of 15% on the side of the support higher in pigment content at a coating weight of 6 g/m$^2$ by an air knife coater.

A backcoat layer was provided by coating on another side of the support a coating composition comprising 100 parts of kaolin (Hydrasperse manufactured by Huber Corporation), 5 parts of polyvinyl alcohol (R Polymer 1130 manufactured by Kuraray Co., Ltd.) and 15 parts of a styrene.butadiene latex (0617 manufactured by Japan Synthetic Rubber Co., Ltd.) and having a solid concentration of 35% at a coating weight of 8 g/m$^2$ by an air knife coater.

Thereafter, the coated support was subjected to calendering treatment under a linear pressure of 100 kg/cm to obtain an ink jet recording sheet.

EXAMPLE 11

A support was produced by mixing a wood pulp comprising 80 parts of LBKP (freeness: 400 ml csf) and 20 parts of NBKP (freeness: 480 ml csf) with 35 parts of pigments comprising precipitated calcium carbonate/ground carbonate/talc (30/35/35), 0.10 part of commercially available alkyl ketene dimer, 0.03 part of commercially available cationic acrylamide having a molecular weight of 7,000,000, 1.0 part of commercially available cationized starch and 0.05 part of aluminum sulfate and making the mixture into a paper by a Fourdrinier paper machine. The resulting support had a basis weight of 90 g/m$^2$, an ash content of 23.3% and a pigment area ratio of 40/60. The same ink-receiving layer and backcoat layer as in Example 10 were provided on the support and then subjected to calendering treatment in the same manner as in Example 10 to obtain an ink jet recording sheet.

EXAMPLE 12

A support was produced by mixing a wood pulp comprising 80 parts of LBKP (freehess: 400 ml csf) and 20 parts of NBKP (freeness: 480 ml csf) with 40 parts of pigments comprising precipitated calcium carbonate/ground carbonate/talc (30/35/35), 0.1 part of commercially available alkyl ketene dimer, 0.03 part of commercially available cationic acrylamide having a molecular weight of 7,000,000, 1.0 part of commercially available cationized starch and 0.05 part of aluminum sulfate and making the mixture into a paper by a Fourdrinier paper machine. The resulting support had a basis weight of 90 g/m$^2$, an ash content of 28.1% and a pigment area ratio of 32/68. The same ink-receiving layer and backcoat layer as in Example 10 were provided on the support and then subjected to calendering treatment in the same manner as in Example 10 to obtain an ink jet recording sheet.

EXAMPLE 13

A support was produced by mixing a wood pulp comprising 80 parts of LBKP (freeness: 400 ml csf) and 20 parts of NBKP (freeness: 480 ml csf) with 15 parts of pigments comprising precipitated calcium carbonate/ground carbonate/talc (30/35/35), 0.05 part of commercially available alkyl ketene dimer and 0.03 part of commercially available cationic acrylamide having a molecular weight of 5,000,000 and making the mixture into a paper by a twin wire paper machine. The resulting support had a basis weight of 90 g/m$^2$, an ash content of 11.5% and a pigment area ratio of 45/55. The same ink-receiving layer and backcoat layer as in Example 10 were provided on the support and then subjected to calendering treatment in the same manner as in Example 10 to obtain an ink jet recording sheet.

EXAMPLE 14

A support was produced by mixing a wood pulp comprising 80 parts of LBKP (freeness: 400 ml csf) and 20 parts of NBKP (freeness: 480 ml csf) with 15 parts of pigments comprising precipitated calcium carbonate/ground carbonate/talc (30/35/35), 0.05 part of commercially available alkyl ketene dimer and 0.03 part of commercially available cationic acrylamide having a molecular weight of 2,000,000 and making the mixture into a paper by a Fourdrinier paper machine. The resulting support had a basis weight of 90 g/m$^2$, an ash content of 10.3% and a pigment area ratio of 26/74. The same ink-receiving layer and backcoat layer as in Example 10 were provided on the support and then subjected to calendering treatment in the same manner as in Example 10 to obtain an ink jet recording sheet.

EXAMPLE 15

A support was obtained in the same manner as in Example 12. The same ink-receiving layer as in Example 10 was provided on the side of the support higher in the pigment content at a coating weight of 6 g/m$^2$ and at a solid concentration of the coating composition of 17% by a roll coater. Furthermore, the same backcoat layer as in Example 10 was provided in the same manner as in Example 10. The coated support was subjected to a calendering treatment in the same manner as in Example 10 to obtain an ink jet recording sheet.

EXAMPLE 16

A support was obtained in the same manner as in Example 12. The same ink-receiving layer as in Example 10 was provided on the support at a coating weight of 6 g/m$^2$ and at a solid concentration of the coating composition of 18% by a rod coater. Furthermore, the same backcoat layer as in Example 10 was provided in the same manner as in Example 10. The coated support was subjected to a calendering treatment in the same manner as in Example 10 to obtain an ink jet recording sheet.

EXAMPLE 17

A support was produced by mixing a wood pulp comprising 80 parts of LBKP (freeness: 400 ml csf) and 20 parts of NBKP (freehess: 480 ml csf) with 20 parts of pigments comprising precipitated calcium carbonate/ground carbonate/talc (30/35/35), 0.05 part of commercially available alkyl ketene dimer and 0.03 part of commercially available cationic acrylamide having a molecular weight of 2,000,000 and making the mixture into a paper by a Fourdrinier paper machine. The resulting support had a basis weight of 90 g/m$^2$, an ash content of 11.8% and a pigment area ratio of 23/77. The same ink-receiving layer as in Example 10 was coated on the side of the support lower in the pigment content at a coating weight of 6 g/m$^2$ by an air knife. A backcoat layer was provided on another side of the support in the same manner as in Example 10. The coated support was subjected to calendering treatment in the same manner as in Example 10 to obtain an ink jet recording sheet.

EXAMPLE 18

A support was obtained in the same manner as in Example 17. The same ink-receiving layer as in Example 10 was provided on the side of the support higher in pigment content at a coating weight of 6 g/m$^2$ by an air knife coater. Furthermore, the same backcoat layer as in Example 10 was provided on another side of the support in the same manner as in Example 10 to obtain an ink jet recording sheet.

EXAMPLE 19

A support was obtained in the same manner as in Example 12. The same ink-receiving layer as in Example 10 was coated on the side of the support lower in pigment content at a coating weight of 6 g/m$^2$ by an air knife coater. Furthermore, the same backcoat layer as in Example 10 was provided on another side of the support in the same manner as in Example 10 to obtain an ink jet recording sheet.

Construction and results of evaluation of the samples are shown in Table 2.

TABLE 2

| | Example 10 | Example 11 | Example 12 | Example 13 | Example 14 | Example 15 | Example 16 | Comparative Example 17 | Comparative Example 18 | Comparative Example 19 |
|---|---|---|---|---|---|---|---|---|---|---|
| [Support] Paper machine | Fourdriner paper machine | | | Twin wire paper machine | | Fourdriner paper machine | | | | Twin wire paper machine |
| LBKP | 80 (freeness 400 mlcsf) | | | | | | | | | |
| NBKP | 20 (freeness 480 mlcsf) | | | | | | | | | |
| Pigment | 30 | 35 | 40 | 15 | 40 | | | 20 | | 15 |
| Precipitated calcium carbonate | 9 | 10.5 | 12 | 5.3 | 12 | | | 7 | | 5.3 |
| Heavy calcium carbonate | 10.5 | 12.3 | 14 | 4.5 | 14 | | | 6 | | 4.5 |
| Talc | 10.5 | 12.3 | 14 | 4.5 | 14 | | | 6 | | 4.5 |
| Alkyl ketene dimer | 0.08 | 0.10 | 0.10 | 0.05 | 0.10 | | | 0.05 | | 0.05 |
| Cationic acrylamide | 0.03 | 0.03 | 0.03 | 0.03 | 0.03 | | | 0.03 | | 0.03 |
| Cationized starch | — | 1.0 | 1.0 | — | 1.0 | | | — | | — |
| Aluminum sulfate | — | 0.05 | 0.05 | — | 0.05 | | | — | | — |
| Basis weight (g/m$^2$) | 90 | | | | | | | | | |
| Content of pigment (%) | 17.5 | 23.3 | 28.1 | 11.5 | 10.3 | 28.1 | | 11.8 | | 11.5 |
| Pigment area ratio in section S1/S2 | 35/65 | 40/60 | 32/68 | 45/55 | 26/74 | 32/68 | | 23/77 | | 45/55 |
| Coated side of ink-receiving layer | S2 side | | | | | | | S1 side | S2 side | S1 side |
| [Ink-receiving layer] | | | | | | | | | | |
| Synthetic amorphous silica | 100 | | | | | | | | | |
| Polyvinyl alcohol | 60 | | | | | | | | | |
| Solid concentration (%) | 15 | | | | | | | | | |
| Coating amount (g/m$^2$) | 6 | | | | | | | | | |
| Coating method | Air knife | | | | | Roll | Rod | Air knife | | |
| [Backcoat layer] | | | | | | | | | | |
| Kaolin | 100 | | | | | | | | | |
| Polyvinyl alcohol | 5 | | | | | | | | | |
| SBR latex 0617 | 15 | | | | | | | | | |
| Solid concentration (%) | 35 | | | | | | | | | |
| Coating amount (g/m$^2$) | 8 | | | | | | | | | |
| Coating method | Air knife | | | | | | | | | |
| Calendering linear pressure (kg/cm) | 100 kg/cm | | | | | | | | | |
| Internal bond strength g/cm | 227 | 201 | 176 | 321 | 315 | 168 | 170 | 270 | 253 | 332 |
| Printed image density (black) | 1.32 | 1.33 | 1.33 | 1.32 | 1.31 | 1.34 | 1.35 | 1.26 | 1.32 | 1.27 |
| Diameter of dot (μm) (cyan) | 347 | 345 | 339 | 362 | 361 | 320 | 317 | 394 | 353 | 369 |
| (magenta) | 361 | 353 | 350 | 379 | 377 | 342 | 336 | 421 | 366 | 389 |
| (cyan + magenta) | 411 | 395 | 389 | 446 | 434 | 376 | 363 | 635 | 426 | 579 |
| Degree of spread of ink dots in ink overlapped portion | 1.14 | 1.12 | 1.11 | 1.18 | 1.15 | 1.10 | 1.08 | 1.51 | 1.16 | 1.49 |
| Waviness after printing | A | A | A | A | A | A | A | C | B | A |
| Staining | A | A | A | A | A | A | A | A | A | A |
| Strike-through | 0.17 | 0.15 | 0.15 | 0.19 | 0.18 | 0.14 | 0.13 | 0.30 | 0.26 | 0.28 |
| Peeling of ink-receiving layer | No problem | | | | | | | | Practically unacceptable | No problem |

As can be seen from the results of Examples 10–14, in the case of a support mainly composed of wood fibers and pigment, an ink-receiving layer is provided on the side of the support higher in content of the pigment than another side, the characteristics required for ink jet recording sheet are improved and the proportion of the pigment in the support which is expressed by pigment area ratio considerably affects the ink jet recording properties. Especially, the ratio has strong relation with the degree of spread of ink dots in the portion where two or more inks are overlapped and the effect can be further ensured by setting the pigment area ratio within a specific range. Furthermore, when ash content is 10% by weight or more, preferably 20% by weight or more, the degree of the spread of ink dots in the ink overlapped portion is reduced and strike-through can be inhibited. However, as seen in Example 18, when the pigment area ratio in the support is less than 25/75, while the printed image density and the degree of the spread of ink dots can be maintained by providing the ink-receiving layer on the higher ash side, cockling due to two-sidedness of the support becomes worse and strike-through as well, and furthermore, peeling of the ink-receiving layer (coming-off of the layer composition in a form of powder) can be of problem.

On the other hand, in Examples 17 and 19 where the degree of spread of ink dots in the ink overlapped portion is high and the dots of the ink overlapped portion spreads largely and therefore, color quality and sharpness are deteriorated and image reproducibility is inferior and in addition, the ink strikes through the support. Furthermore, great cockling occurs as shown in Example 17. This is considered to occur due to the expansion and contraction of the wood fibers in the horizontal direction caused by diffusion of ink in the horizontal direction as can also be seen from the degree of spread of ink dots in the ink overlapped portion.

As is clear from Examples 12, 15 and 16, when the ink-receiving layer is provided by a roll coater or a rod coater, increase in dot diameter and in the degree of spread of ink dots is inhibited and the image reproducibility can be improved.

As explained above, a coat type ink jet recording sheet which can provide images of high density, is less in strike-through and cockling and is considerably reduced in spread of ink dots in the ink overlapped portion can be obtained by setting S1/S2 in the range of 25/75 to 45/55 and providing an ink-receiving layer on the side of S2 of the support.

What is claimed is:

1. An ink jet recording sheet which comprises a support comprising wood fibers and pigment and at least one ink-receiving layer provided on a face of the support, wherein content of the pigment in the support is 5–36% by weight; the recording sheet has an internal bond strength of 150–455 g/cm; and, when a cross section of the support taken perpendicular to the face of the recording sheet is divided into two equal portions and a pigment area S1 and S2 for each portion determined, the pigment area ratio S1/S2 is 25/75–45/55 and at least one ink-receiving layer is provided on the side of S2 in said area ratio of the support.

2. An ink jet recording sheet according to claim 1, wherein the content of the pigment in the support is 10–30% by weight.

3. An ink jet recording sheet according to claim 1, wherein coating weight of the ink-receiving layer coated on the support is 1–10 $g/m^2$.

4. An ink jet recording sheet according to claim 1, wherein a backcoat layer is coated on another side of the support.

5. An ink jet recording sheet according to claim 1, wherein the ink-receiving layer is coated by a roll coater or a rod coater.

6. An ink recording sheet according to claim 5, wherein the ink-receiving layer is coated on the support at a coating weight of 1–10 $g/m^2$.

* * * * *